US005613764A

United States Patent [19]

O'Brien

[11] Patent Number: 5,613,764

[45] Date of Patent: Mar. 25, 1997

[54] INTERNALLY ILLUMINATED DECORATIVE OBJECTS

[75] Inventor: Patrick O'Brien, Maywood, N.J.

[73] Assignee: Cristofell Group Ltd., Maywood, N.J.

[21] Appl. No.: 421,364

[22] Filed: Apr. 12, 1995

[51] Int. Cl.[6] ..... F21P 1/00

[52] U.S. Cl. ..... 362/252; 362/397; 362/806; 362/808; 40/540

[58] Field of Search ..... 362/806, 808, 362/396, 397, 252; 40/538, 540, 800; 248/260.1, 260.2, 260.3

[56] References Cited

U.S. PATENT DOCUMENTS

| | | | |
|---|---|---|---|
| 3,220,130 | 11/1965 | Falkenberg | 362/808 |
| 4,833,580 | 5/1989 | Allen | 362/806 |
| 5,315,492 | 5/1994 | Davenport | 362/397 |
| 5,359,506 | 10/1994 | Koleno | 362/252 |

FOREIGN PATENT DOCUMENTS

| | | | |
|---|---|---|---|
| 984356 | 2/1976 | Canada | 362/808 |

*Primary Examiner*—James C. Yeung

*Attorney, Agent, or Firm*—Kirschstein, et al.

[57] ABSTRACT

An internally illuminated decorative object includes an electric light including a lamp socket and light bulb replaceably mounted in the lamp socket. The electric light is supported on a support member that has at least one through opening for the passage of the light bulb therethrough from its first to its second side. A flat translucent image-bearing member is mounted on the support member so as to be at least coextensive with the second side of the support member for illumination by the light bulb when the latter is lit as electric current is supplied to it. The support member has a central portion and two wings flanking the central portion and connected to the image-bearing member by respective lugs that pass through associated slots of the image-bearing member. The central portion of the support member includes a wall that extends along an arcuate course and two end walls situated at vertically spaced end regions of the arcuate wall as considered in a condition of use of the object and rigidly connected with the wall to maintain it in substantial conformity with the arcuate course. The wings are connected to the central portion of the support member by respective vertically extending hinge regions as considered in the use condition for pivoting about the hinge regions at least as the decorative object is being assembled.

18 Claims, 5 Drawing Sheets

INTERNALLY ILLUMINATED DECORATIVE OBJECTS

BACKGROUND OF THE INVENTION

1. Field of the Invention

The present invention relates to decorations in general, and more particularly to internally illuminated decorative objects.

2. Description of the Related Art

There are already known various constructions and configurations of diverse decorations intended to be and actually used to celebrate, commemorate or observe any one of many festive or holiday periods, such Christmas or Hanukkah, Chinese New Year, Halloween, etc. Typically, the character of the respective decoration is geared to the kind of event for which it is to be used, even though there are some decorative objects (such as candles) that are sufficiently "neutral" to be usable for more than one occasion.

More elaborate decorative objects, however, are usually predestined for a single purpose, that is, for just one event. Santa Claus and/or reindeer statuettes, which are usually hollow to be easily transportable from the storage to the display area and back, and are typically made of cast or molded synthetic material and painted in various colors, are examples of such more elaborate objects that are only used during the Christmas season. In this context, it has already been proposed to choose a material for such statuettes that is at least translucent, and to light them from the inside by electric lights that are strategically placed in the hollow interiors of such statuettes. Of course, the internal illumination of such decorative objects is intended to make them prominent or noticeable during the evening and night hours.

Examples of illuminated decorative objects can be found in the following U.S. Pat. Nos. 4,977,695; 4,989,126; 4,995,181; 5,016,145; 5,165,790; 5,237,766; 5,311,417 and 5,315,492.

However, despite the apparent attractiveness of these known decorative objects, they have not found widespread use. For one, it is believed that the relatively high cost of such objects dissuades many people from purchasing them. On the other hand, the relatively huge amount of space that these statuettes occupy even when not being used, which is more than 95% of the time, may constitute another weighty reason why they have not found wider acceptance than they did.

OBJECTS OF THE INVENTION

Accordingly, it is a general object of the present invention to avoid the disadvantages of the prior art.

More particularly, it is an object of the present invention to provide a decorative object that does not possess the drawbacks of the known objects of this type.

Still another object of the present invention is to devise a decorative object of the type here under consideration that can be illuminated from a concealed light source and yet occupies only a relatively small amount of space especially when in storage.

An additional object of the present invention is to design the above illuminated decorative object so that it is easily assembleable from a collapsed, knock-down form to an assembled condition of use for display purposes, and easily dissassembleable to the collapsed form for compact storage purposes.

It is yet another object of the present invention to design the above illuminated decorative object in such a manner as to give the impression of three-dimensionality even if it does not exist in fact.

A concomitant object of the present invention is so to construct the decorative object of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in an internally illuminated decorative object that includes an electric light including a lamp socket and light bulb replaceably mounted in the lamp socket, means for supplying electric current to the lamp socket and through the same to the light bulb to light the latter, and means for supporting the electric light, including a support member having at least one opening for the reception of the light bulb therethrough. According to the invention, there is further provided a translucent image-bearing member and means for mounting the image-bearing member on the support member so as to be at least coextensive with a side of the support member for illumination by the light bulb when the latter is lit.

Advantageously, the opening extends from a first to a second side of the support member, and the image-bearing member is substantially flat and/or extends at least in one direction beyond the second side of the support member. It is further advantageous when the support member is constructed to have a central portion and two wings flanking the central portion, and when the mounting means connects the wings to the image-bearing member. In this context, the mounting means advantageously includes at least one lug, but preferably two lugs, on each of the wings of the support member, and respective associated regions of the image-bearing member that bound respective slots for the lugs to pass through, each lug engaging one of the associated regions. Then, at least one of the wings may include at least one open-ended slot between its lug, or at least one of its two lugs, and the remainder of the one wing for receiving a portion of the respective one of the associated regions of the image-bearing member to lock the one wing and the image-bearing member in place with respect to one another against unintentional dissociation. Such an open-ended slot may open in the upward or in the downward direction as considered in an assembled condition of use of the decorative object, depending on the circumstances, with the first alternative being preferred when the support member is to support the object by standing on a horizontal surface, and the second alternative when the object is to be suspended in its use condition on a vertical surface.

According to an advantageous aspect of the present invention, the central portion of the support member includes a wall that extends along an arcuate course at least when the mounting means connects the wings of the support member to the image-bearing member in an assembled condition of use of the decorative object. Under these circumstances, the central portion of the support member may further include two end walls situated at vertically spaced end regions of the arcuate wall as considered in an assembled condition of use of the decorative object and rigidly connected with the arcuate wall to maintain the same in substantial conformity with the arcuate course. The wings are advantageously connected to the central portion of the support member by respective vertically extending hinge regions as considered in an assembled condition of use of the decorative object for pivoting about the hinge regions at least as the decorative object is being assembled.

According to another facet of the present invention, the decorative object further includes a reflector arranged on the one side of the support member around its opening and operative for reflecting light issued by the light bulb toward the image-bearing member in an assembled condition of use of the decorative object. The reflector is advantageously constituted by a reflective self-adhesive decal adhesively connected to the central portion of the support member around its opening. The use of such a reflector is particularly advantageous when, in further accord with the present invention, the support member is of a transparent material.

Yet another advantageous feature of the invention may be found in the provision of a suction cup and means for connecting the suction cup to an upper region of the image-bearing member at a frontwardly facing surface of the latter as considered in an assembled condition of use of the decorative object. The suction cup holds the decorative object in a suspended condition thereof on a vertically extending transparent support, especially a window pane. Such connecting means advantageously includes means for bounding a close-ended slot in the upper region of the image-bearing member, and a bar-shaped portion of the suction cup that is dimensioned to pass through the close-ended slot in an initial position of the suction cup but engages behind the upper region when the suction cup is turned out of the initial position thereof about a substantially horizontal axis as considered in an assembled condition of use of the decorative object.

Another feature of this invention resides in a holder at one side of the support member. The holder has a through passage formed with a waist or a constriction for snugly receiving the electric light, preferably in a vertical orientation.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
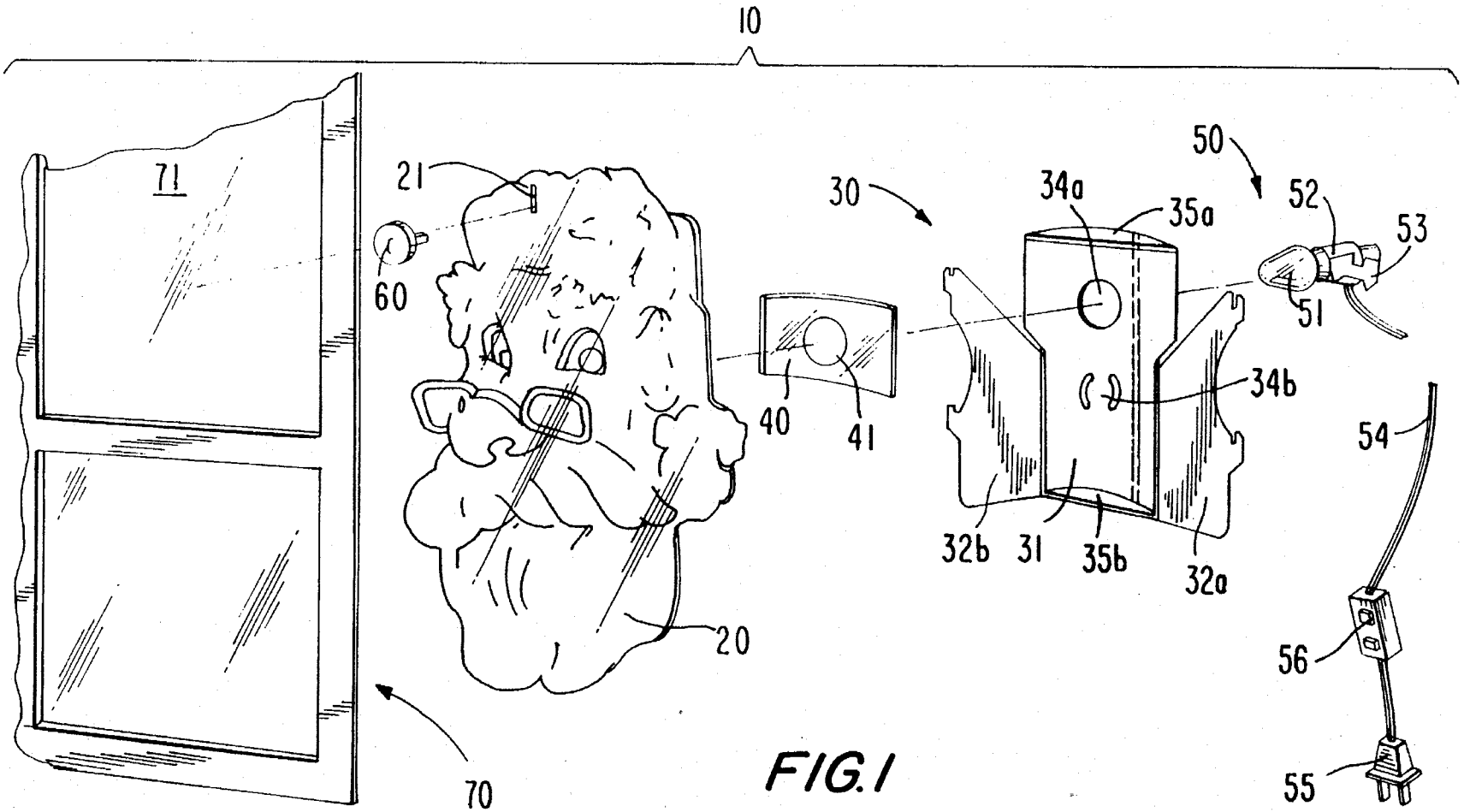
FIG. 1 is an exploded perspective side view of a decorative object of the present invention showing various components thereof and indicating one possible use of the object.

Referring now to the drawing in detail, and first to FIG. 1 thereof, it may be seen that the reference numeral 10 has been used therein to identify a decorative object of the present invention in its entirety. The decorative object 10 includes, as one of its main components, an image-bearing member 20. While this member 20 has been shown to bear the likeness of Santa Claus, it should be understood that any other image, such as that of a witch for Halloween, that of a turkey for Thanksgiving, etc., could be used instead. Also, while the outer contour of the member 20 is shown to substantially conform to that of the image it bears, it need not necessarily be so. It is currently contemplated for the image-bearing member 20 to be constituted by a printed plastic die-cut sheet, that is, to be essentially flat or two-dimensional. This facilitates the manufacture of the member 20 and thus keeps its cost down. The image is preferably offset-printed to obtain a high resolution graphical image, but may be silk-screened, on the sheet. The image has black-and-white and/or colored light-transmissive areas, and opaque areas. The printing may be on one or both sides of member 20. The image may be printed on a clear or colored background.

Other main components of the decorative object or assembly 10 are a support member 30, a reflector member 40, and an electric lighting device 50. Another component, that is less essential at least in some cases but is nevertheless ordinarily supplied as a part of a kit containing the above-mentioned components 20, 30 and 40 in their disassembled condition, is a suction cup 60 that can be used to attach the assembled decorative object to a window 70 so as to be visible, for instance from the outside of a house, though a window pane 71, preferably in its entirety. The suction cup 60 and the image-bearing member 20 are connected to one another in a manner that will be explained later, utilizing a slot 21 that is located at an upper region of the member 10, preferably substantially in the middle. At this juncture, it is to be mentioned that all references made here with respect to directions and relative positions are meant to relate, and are to be interpreted as relating, to the orientation of the various components 20, 30, 40, 50 and 60 of the object 10 that is indicated, albeit in an exploded fashion, in FIG. 1 of the drawing, with the window 70 being situated in front of the assembly 10.

Skipping the reflector 40 for the time being, the next component that will be described in some detail at this point is the support member 30. The support member 30 includes a substantially tray-shaped or trough-shaped central portion 31 that is flanked by two lateral or wing portions **32*a* and 32*b* that extend over a substantial portion of the vertical dimension of the central portion 31 at opposite sides of the latter. FIG. 1 also shows that the central portion 31 has an opening 34*a* substantially centrally located at its upper region, and an opening precursor 34*b* situated substantially centrally at or below the central region of the central portion 31. The central portion 31 is shown in FIG. 1** to extend along an arcuate course and to be delimited at its upper and lower end zones by respective conformingly configured end walls 35*a* and 35*b*. The end walls 35*a* and 35*b* not only delimit the space bounded by the arcuate wall of the central portion 31 of the support member 30, thus conferring on the latter a shape reminiscent of that of a feeding trough, but also reinforce the same thus giving the entire support member 30 a considerable rigidity that enables the support member 30 to reliably support the light assembly 50 and/or the image-bearing member 20, depending on the circumstances of use of the assembly 10. The support member 30 is a thermo-formed or injection-molded, integral synthetic plastic material unit which may, if desired, be provided with non-illustrated embossed reinforcing ribs for additional strength and rigidity.

Going back now to the reflector 40, it is to be mentioned first that it is currently preferred to make it of a flexible synthetic plastic material, such as that commercially available under the designation Mylar™, that is either inherently reflective or preferably provided with a reflective coating, advantageously on its frontwardly facing surface that is visible in FIG. 1. Such a coating may cover the entire front surface or, if so desired, be confined to merely two patches, typically of rectangular shapes, disposed at the opposite sides of a central through aperture 41 provided in the reflector 40. Advantageously, the reflector is of a self-adhering type (frequently referred to as a decal, a label or, more colloquially, a sticker), so that it can be adhesively connected to the frontwardly facing internal major surface of the central portion 31 of the support member 30. When the reflector 40 is properly connected, its aperture 41 is at least substantially aligned with the opening 34*a* of the support member 30 so that they together form a passage for a portion of the electric light assembly 50 to pass through.

As may be ascertained from FIG. 1 of the drawing, the electric light assembly 50 includes a light source proper that is shown to be constituted by a light bulb 51, and of an arrangement for selectively supplying electric current to the light bulb 51. Such an arrangement includes, in a manner that is conventional so that this arrangement need not and consequently will not be discussed here in any great detail beyond what is needed for understanding the invention, an electric lamp socket 52 for the bulb 51, an electric cable 54, an electric plug 55, and an optional switch 56 that may be interposed in the electric cable 54 between the plug 55 and the socket 52. As indicated by an interruption in the electric cable 54, the latter can have any desired length that will usually exceed by a considerable amount that which is shown in the various figures of the drawing.

It will be appreciated from mere observation of FIG. 1 of the drawing that the light bulb 51 has to be situated in front of the reflector 40 in the assembled condition of use of the decorative object 10 in order to illuminate the image-bearing member 20 from behind and thus to give it a luminous appearance. On the other hand, at least a part of the lamp socket 52 has to be located behind or to the rear of the support member 30. Of course, it is at least desirable, if not necessary to hold the lamp socket 52 and via the same the light bulb 51 in a stable position relative to the support 30. To this end, the lamp socket 52 is equipped with at least one pair 53 of movable, flexible or resiliently yieldable retention clips the function and operation of which will be discussed later. For the time being, suffice it to say that the clip pair 53 engages the support member 30 at the region of its opening 34*a* and thus holds the socket 52 in position, preferably horizontally, relative to the support member 30.

Figures 2, 3:
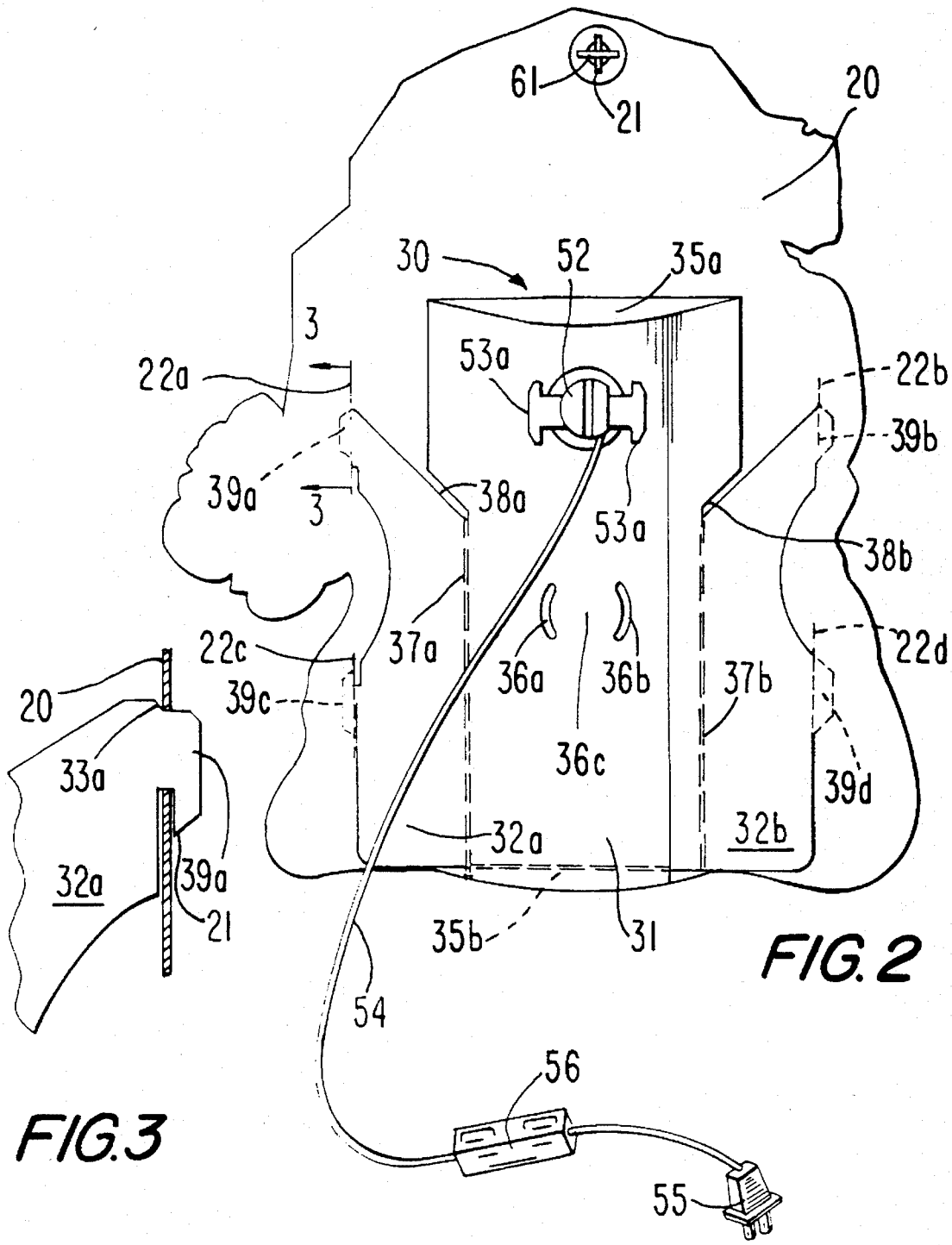
FIG. 2 is a rear elevational view of the decorative object of FIG. 1 in its assembled condition, drawn to a scale exceeding that of FIG. 1 and showing a first version of a support component.
FIG. 3 is a partly sectional, partly side-elevational view taken on line 3—3 of FIG. 2, showing a fragment of the decorative object on an even more enlarged scale.

Turning now to FIG. 2 of the drawing for additional details of the assembly 10, it may be noticed there first that the opening precursor that has been designated before by the reference numeral 34*b* is in reality constituted by punch-out or knock-out wall section 36*c* of the central portion 31 of the support member 30. The section 36*c* is separated from the remainder of the aforementioned portion 31 by two through slots 36*a* and 36*b* extending along substantially identical, mirror-image symmetrical, arcuate and preferably part-circular courses. The presence of the slots 36*a* and 36*b*, coupled with inherent relatively low strength and/or high brittleness of the material of the support member 30, renders it possible to knock out or punch out the section 36*c* if so desired, thus converting the incipient opening 34*b* into an actual one.

Then, the reflector 40 may be placed around the opening 34*b* instead of the opening 34*a*, or an additional electric assembly similar to the assembly 50 can be used, together with an associated reflector corresponding to the reflector 40, in conjunction with the opening 34*b* in addition to the assembly 50 and reflector 40 used at the opening 34*a*. As a matter of fact, even the opening 34*a* may be initially provided as an opening precursor instead of an actual opening 34*a*. This would give the user the opportunity to select for removal that one of such incipient openings 34*a* and 34*b* that he or she prefers for the location of the light bulb/socket combination 51, 52 if only one of such combinations is available and/or to be used.

FIG. 2 of the drawing also indicates one way in which the suction cup 60 can be connected to the image-bearing member 20. More particularly, the cup 60 is in this case provided with a bar-shaped locking portion 61 that is dimensioned to pass through the slot 21 of the member 20 when in its vertical orientation but to engage behind the member 30 when turned about a horizontal axis out of this position. The concept involved here and its implementation should be so clear as not to need any further elaboration.

It is also shown in FIG. 2 of the drawing that the aforementioned clip pair 53 includes two individual clips 53*a* and 53*b*. The clips 53*a* and 53*b* are connected to the lamp socket 53 in such a manner as to be movable relative thereto between their positions indicated in FIG. 1 in which they are able to clear the aforementioned passage 34*a*, 41 (or 34*b*, 41) and their positions shown in FIG. 2 in which they engage the support member 31 adjacent such passage.

The wings 32*a* and 32*b* are indicated in FIG. 2 of the drawing to be integral and/or unitary with the central portion 31. However, rather than being completely rigid with the central portion 31 of the support member 30, the wings 32*a* and 32*b* are flexible or movable relative thereto at least within a limited range. This is attributable in the construction shown in FIGS. 1 to 3 to the fact that the wings 32*a* and 32*b* are connected to the central portion 31 by respective hinge portions 37*a* and 37*b* that constitute weakened regions about which the wings 32*a* and 32*b* can be pivoted, as well as to the presence of respective slots or gaps 38*a* and 38*b* that separate the upper regions of the wings 32*a* and 32*b* from the central portion 31 of the support member 33 and thus permit unimpeded pivoting of the wings 32*a* and 32*b*.

As a comparison of FIGS. 2 and 3 with one another will reveal, the wings 32*a* and 32*b* are provided at their lateral zone with respective pairs of lugs 39*a* and 39*c*, on the one hand, and 39*b* and 39*d*, on the other hand. These lugs 39*a* to 39*d* pass through respective associated slots 22*a* to 22*d* provided at appropriately selected regions of the image-bearing member 20. As can be seen especially in FIG. 3, a recess or open-ended slot 33*a* is provided at the region of transition between the lug 39*a* and the remainder of the wing 32*a*. The presence of the slot 33*a* makes it possible for the lug 39*a* to engage behind (actually, in front of) the image-bearing member 20 and thus to lock the support 30 in place with respect to the member 20, and vice versa. Of course, the lugs 32*b* to 32*d* may be and typically are equipped with their own slots corresponding to the slot 33*a*, even though this is not shown in detail or indicated in FIG. 2 of the drawing in order not to unduly encumber the same.

The decorative object construction that is illustrated in FIGS. 1 to 3 of the drawing, while also capable of being used in conjunction with the suction cup 60 in the application indicated in FIG. 1, i.e. attached to the respective window pane 71, is particularly well suited for use in a different application: standing on top of a table, a dresser or on another horizontal surface. In this case, it is the image-bearing member 20 that is supported on the support member 30, rather than the other way around. The bottom edges of the wings 32*a*, 32*b* and of the member 20 are co-planar with the lower end wall 35*b*, thereby serving as a wide support area to engage the horizontal surface. In this context, it is particularly advantageous when the slot 33*a*, and each other slot like it, opens upwardly as shown in FIG. 3 of the drawing, because then the retaining function of the affected slot such as 33*a* is maximized in that the weight of the member 20 will tend to push the same deeper into, rather than out of, the slot 33*a*.

Figure 4:
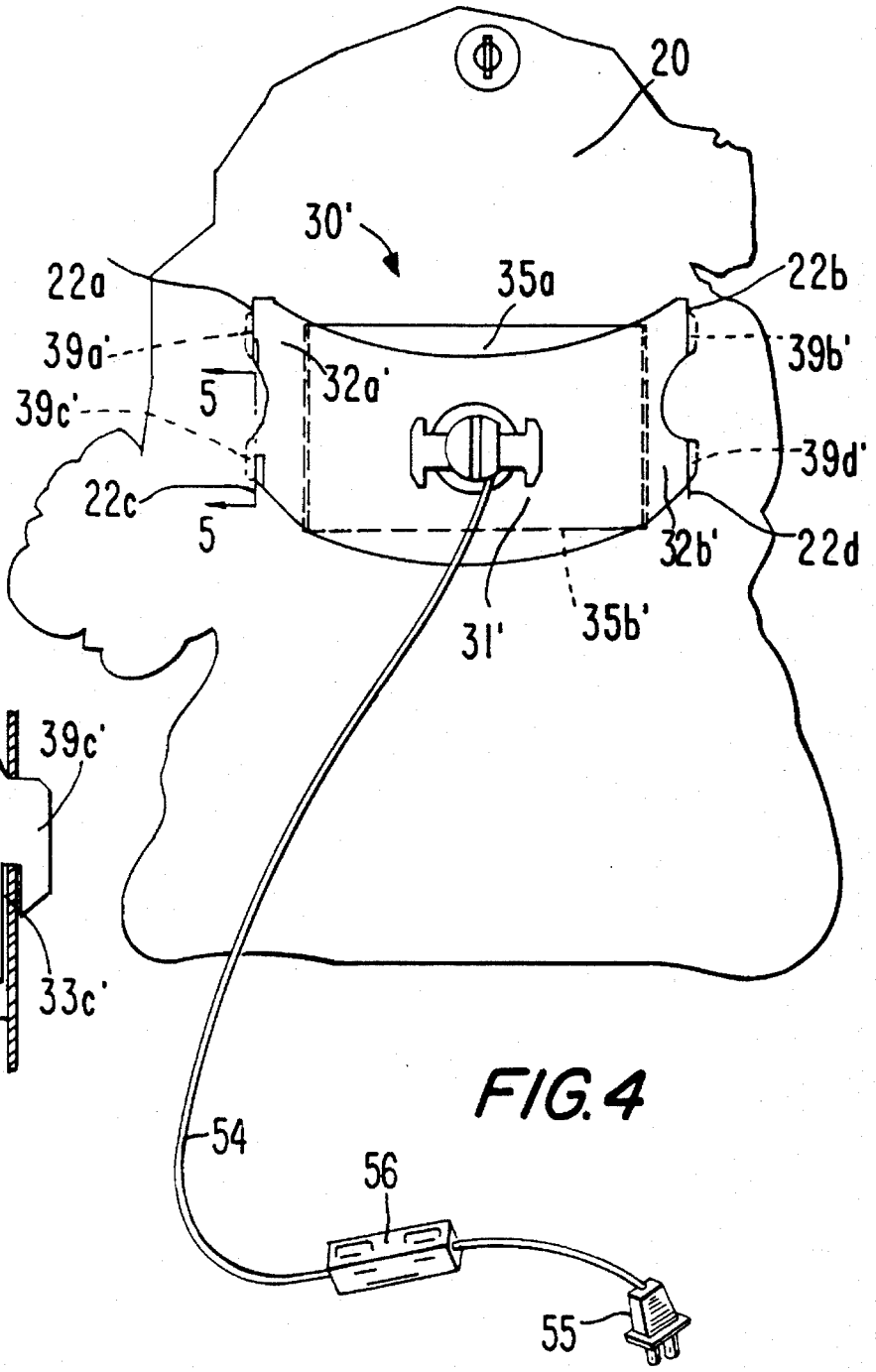
FIG. 4 is a view similar to that of FIG. 2, but showing a second version of the support component.
Figure 5:
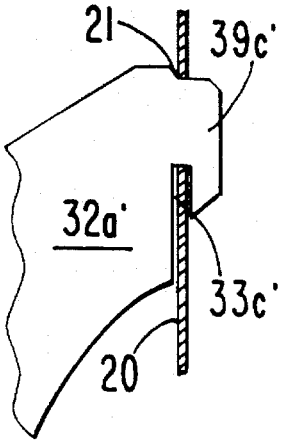
FIG. 5 is a view akin to that of FIG. 4, but taken on line 4—4 of FIG. 4.

A modified construction of the assembly 10 and especially of the support member 30 thereof is revealed in FIGS. 4 and 5 of the drawing. This modified construction is similar to that discussed above to such an extent that the elements that are in common to these two constructions need not and will not be discussed here, nor are they all shown in the drawing. On the other hand, those elements that are functional equivalents of those introduced above but different from them in some respects will be identified by the same reference numerals as before, but each supplemented with a prime.

In this modified construction, the support member 30' does not extend all the way to the bottom of the image-bearing member 20 as it did in FIGS. 1 and 2. Rather, it and its central portion 31' have a vertical dimension amounting to only a small fraction of the height of the member 20. As a result, the entire support member 30' can be situated at the upper half of the image-bearing member 20, as shown in FIG. 4.

This particular implementation of the decorative object 10 is not that well suited for being supported on a horizontal surface but, due to its reduced weight, is much more suitable than the FIG. 1 to 3 version for use in the window-attached application. In this situation, the support member 30' while still serving as a support for the electric light assembly 50, is in reality supported on the image-bearing member 20. This latter supporting action is accomplished by the respective lugs 39*a*' to 39*d*' that pass through the respective associated slots 22*a* to 22*d* of the image-bearing member 20.

Like in the previous construction, a respective retaining slot 33*c*' is shown in FIG. 5 to be present between the lug 39*c*', and the remainder of the respective wing 32*a*'. This time, however, the slot 33*c*', and each other akin to it, opens downwardly rather than upwardly. This is very practical in the aforementioned preferred mode of using the decorative object 10 of FIGS. 4 and 5 in that the weight of the support member 30 causes the slot 33*c*' to slide further down onto the affected portion of the member 20, rather than off of it.

It may be seen from the above explanation that the direction in which the respective slot such as 33*a* or 33*c*' opens is preferably chosen in dependence on the intended application of the object 10, i.e. whether the latter is intended to be suspended or stand on the bottom of its support member such as 30. Yet, at least a certain degree of universality could be obtained if two of the slots (one on each side) opened upwardly, and the remaining two downwardly, or if both an upwardly open and a downwardly open slot were provided at each of the lugs.

Figure 6:
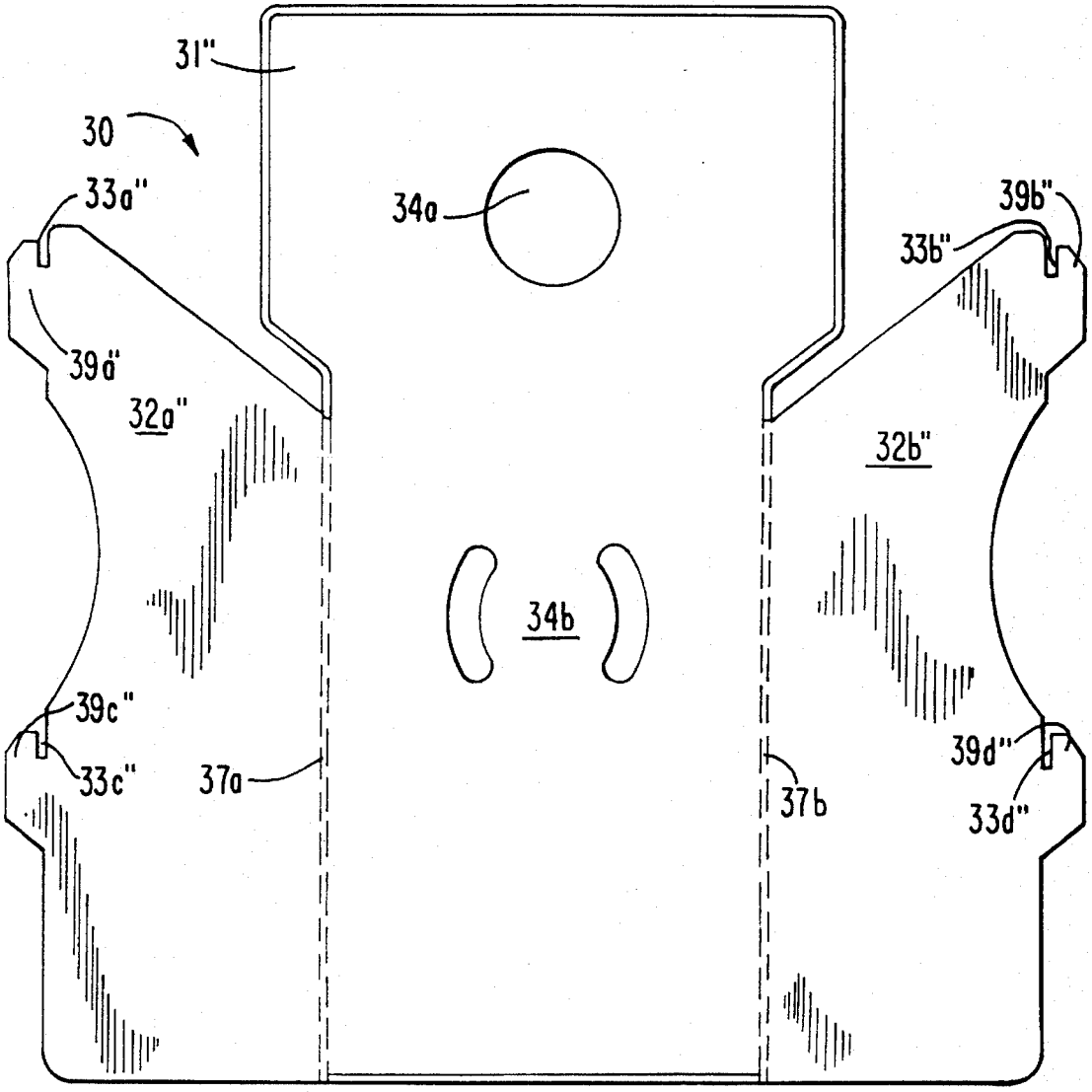
FIG. 6 is a view corresponding to FIG. 2, but showing just the support component in its third version.

Further details of the construction of the support member may be ascertained from FIG. 6 in which the support member is shown by itself. Here again, the basic similarity of the constructions made it possible to refrain from discussing in detail those parts that have already been described above, and to designate the functionally equivalent parts by the same reference numerals as before, but amplified by a double prime. Here, all of the upwardly open slots 33*a*" to 33*d*" provided on the respective wings 32*a*" and 32*b*" that are connected to the central portion 31" by the hinges 37*a* and 37*b*, respectively, are clearly visible. The main difference from the constructions described above is that the aforementioned upper and lower end walls (such as 35*a* and 35*b*) are conspicuously absent from the construction shown in FIG. 6. This means that the central portion 31" can be and is substantially flat or planar, and it is the wings 32*a*" and 32*b*" alone that hold the central portion 31" at the requisite distance from the image-bearing member 20 when the decorative object 10 is in its assembled state. The lower edges of the wings 32*a*", 32*b*" and the lower edge of the central portion 31" lie in a common plane with the lower edge of the member 20, thereby serving as the support on a horizontal surface. In an alternative to this approach that is not illustrated, even the weakened hinges 37*a* and 37*b* can be omitted, but the entire support member 30" is made of a flexible material and is bent during the assembling operation such as to extend along an arcuate or part-cylindrical course upon assembly.

Figure 7:
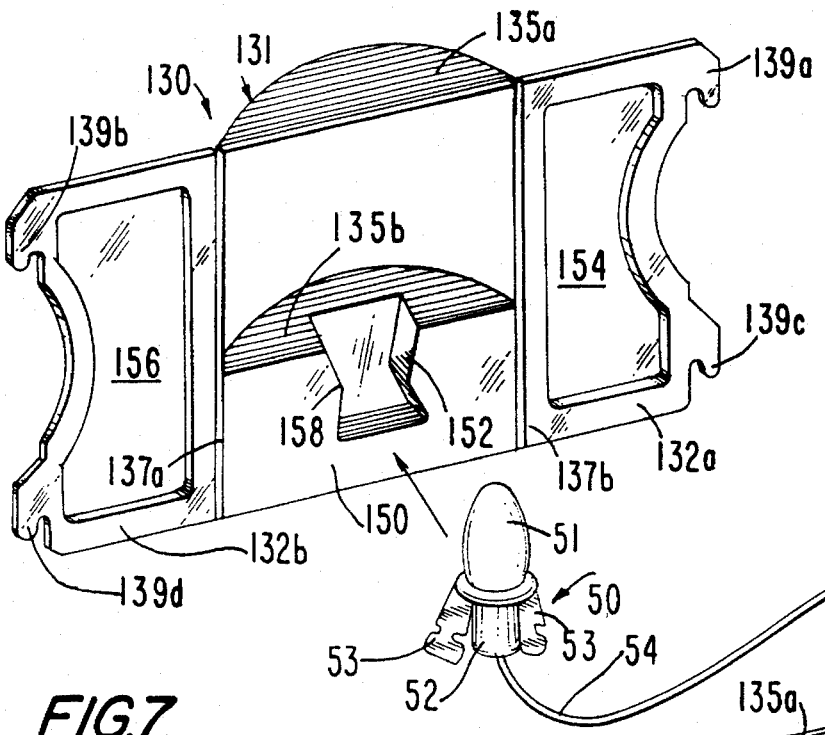
FIG. 7 is a top front perspective view of a fourth version of a support component, together with an electric light assembly in exploded view.
Figure 8:
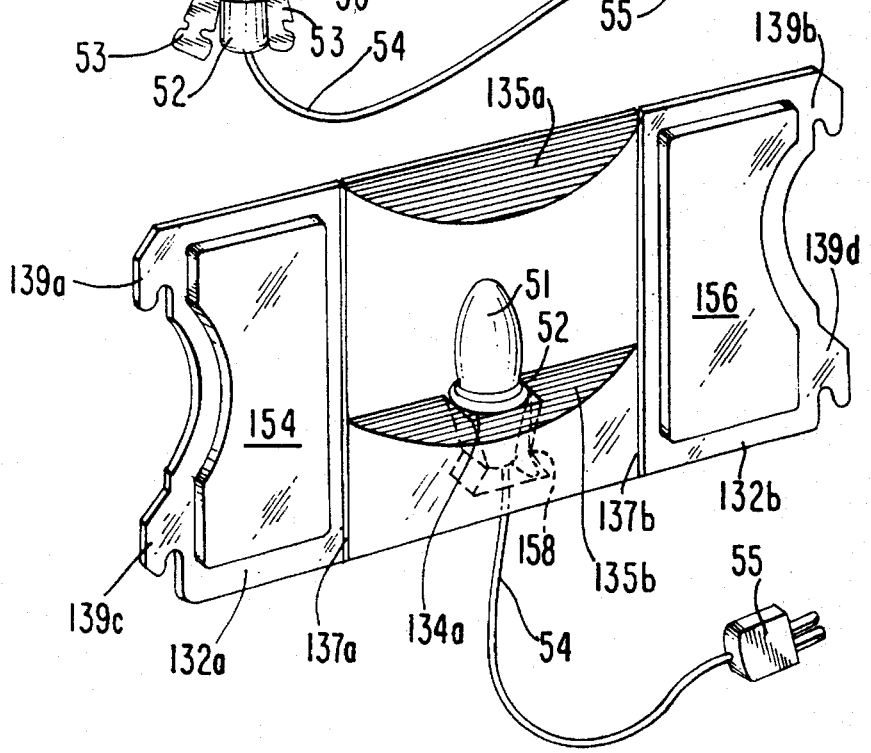
FIG. 8 is a top rear perspective view of the support component of FIG. 7.

The details of the construction of still another version of the support member can be ascertained from FIGS. 7 and 8. To designate functionally equivalent parts, the same reference numerals as employed above in the other versions have been used, but increased by the numeral one hundred. Thus, the support member 130 includes a central portion 131 flanked by wing portions 132*a*, 132*b*. Central portion 131 has an upper trough-shaped section extending between end walls 135*a*, 135*b*, and a lower planar section 150 on which a holder 152 is vertically arranged. The wing portions 132*a*, 132*b* are movable about vertical hinges 137*a*, 137*b*, and also have lugs 139*a*, 139*c* and 139*b*, 139*d* for engaging slots in the image bearing member 20, as previously described.

It will be noted that the wing portions 132*a*, 132*b* have embossed regions 154, 156 for increased rigidity. Also, the holder 152 has a vertically extending passage 134*a* having a constriction or waist 158 into which the clips 53 of the light assembly 50 are resiliently held in order to support the bulb in an upright orientation relative to the member 20.

The material of which the support member 30, 30', 30" or 130 is made is preferably transparent, synthetic plastic material. This feature was adopted because it was established that the back-lighting of the image-bearing member 20 is unpredictable and unreliable when the support member material is opaque, inasmuch as undesirable, sometimes even multiple, reflections can then occur from various regions of the support member 30, 30', 30" or 130, resulting in the appearance of "light" and "shadow" streaks, blotches or the like on the image being observed. This problem is virtually eliminated when the light that is neither aimed directly on the image-bearing element 20 nor reflected toward the same by the reflector 40 is permitted to escape substantially without hindrance through the transparent material of the support member 30, 30', 30" or 130.

Each plastic support member 30, 30', 30", 130 is sufficiently strong to serve as a convenient handle by which a person holds the image-bearing member 20 during transport from one position to another. This protects the member 20 from soiling and possible damage.

All of the components are advantageously separately packaged in a kit in a knock-down, collapsed form for shipping, merchandising and compact storage. The components are easily assembleable to an erect form for display purposes as described above, and easily disassembleable back to the collapsed form.

It will be understood that each of the elements described above, or two or more together, may also find a useful application in other types of constructions differing from the type described above.

While the present invention has been described and illustrated herein as embodied in certain specific constructions of an internally illuminated decorative object, it is not limited to the details of this particular construction, since various modifications and structural changes may be made without departing from the spirit of the present invention. So, for instance, the image-bearing member 30 could be provided with thicker and thinner portions and/or with a relief shape to make the image-bearing member 30 look more "plastic" or three dimensional. Member 30 could be thermo-formed or injection-molded to create the more sculptured, three-dimensional effect.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. An internally illuminated decorative object, comprising:

a) an electric light including a lamp socket and light bulb replaceably mounted in said lamp socket;

b) means for supplying electric current to said lamp socket and through the same to said light bulb to light the latter;

c) means for supporting said electric light, including a support member having at least one opening for the reception of said electric light bulb therethrough, a central portion, and two outstretched wings flanking and extending outwardly of said central portion;

d) a translucent image-bearing sheet extending continuously throughout its entire expanse over a continuous, printed surface on which an image is printed; and e) means for mounting said image-bearing sheet on said wings of said support member at discrete spaced-apart locations on said image-bearing sheet so as to be at least coextensive with a side of said support member for illumination by said light bulb when the latter is lit.

2. The decorative object as defined in claim 1, wherein said opening extends from a first to a second side of said support member.

3. The decorative object as defined in claim 1, wherein said central portion includes a wall that extends along an arcuate course at least when said mounting means connects said wings of said support member to said image-bearing sheet in an assembled condition of the decorative object.

4. The decorative object as defined in claim 3, wherein said central portion of said support member further includes two end walls situated at vertically spaced end regions of said arcuate wall as considered in an assembled condition of use of the decorative object and rigidly connected with said wall to maintain the same in substantial conformity with said arcuate course.

5. The decorative object as defined in claim 1, and further comprising a reflector arranged on said side of said support member around said opening of the latter and operative for reflecting light issued by said light bulb toward said image-bearing sheet in an assembled condition of use of the decorative object.

6. The decorative object as defined in claim 5, wherein said reflector is constituted by a reflective self-adhesive decal adhesively connected to said central portion of said support member around said opening of the latter.

7. The decorative object as defined in claim 1, wherein said support member is of a transparent material.

8. The decorative object as defined in claim 1, and further comprising a suction cup and means for connecting said suction cup to an upper region of said image-bearing sheet at a frontwardly facing surface of the latter as considered in an assembled condition of use of the decorative object for said suction cup to hold the decorative object in a suspended condition thereof on a vertically extending transparent support.

9. The decorative object as defined in claim 8, wherein said connecting means includes means for bounding a close-ended slot in said upper region of said image-bearing sheet, and a bar-shaped portion of said suction cup that is dimensioned to pass through said close-ended slot in an initial position of said suction cup but engages behind said upper region when said suction cup is turned out of said initial position thereof about a substantially horizontal axis as considered in an assembled condition of use of the decorative object.

10. The decorative object as defined in claim 1, wherein said image-bearing member and said support sheet have lower edges lying in a common plane to support the decorative object on a horizontally extending support surface.

11. The decorative object as defined in claim 1, wherein said support member has a removable wall portion for forming an additional through opening for the passage of said light bulb upon removal of said wall portion.

12. The decorative object as defined in claim 1, wherein said support member has a holder at said side thereof, and wherein said opening extends through said holder, and wherein said holder has a waist for snugly receiving said light.

13. An internally illuminated decorative object, comprising:

a) an electric light including a lamp socket and light bulb replaceably mounted in said lamp socket;

b) means for supplying electric current to said lamp socket and through the same to said light bulb to light the latter;

c) means for supporting said electric light, including a support member having at least one opening for the reception of said electric light bulb therethrough, a central portion and two wings flanking said central portion;

d) a translucent image-bearing member; and e) means for mounting said image-bearing member on said support member so as to be at least coextensive with a side of said support member for illumination by said light bulb when the latter is lit, said mounting means connecting said wings to said image-bearing member, said mounting means including at least one lug on each of said wings of said support member, and respective associated regions of said image-bearing member that bound respective slots for said lugs to pass through, each lug engaging one of said associated regions.

14. The decorative object as defined in claim 13, wherein at least one of said wings includes at least one open-ended slot between said lug thereof and the remainder of said one wing for receiving a portion of the respective one of said associated regions of said image-bearing member to lock said one wing and said image-bearing member in place with respect to one another against unintentional dissociation.

15. The decorative object as defined in claim 14, wherein said open-ended slot opens in the upward direction as considered in an assembled condition of use of the decorative object.

16. The decorative object as defined in claim 14, wherein said open-ended slot opens in the downward direction as considered in an assembled condition of use of the decorative object.

17. The decorative object as defined in claim 1, wherein said mounting means further includes an additional lug on each of said wings and additional associated regions on said image-bearing object, said additional lugs and associated regions being similar to said lugs and associated regions and being spaced therefrom substantially in the vertical direction as direction as considered in an assembled condition of use of the decorative object.

18. An internally illuminated decorative object, comprising:

a) an electric light including a lamp socket and light bulb replaceably mounted in said lamp socket;

b) means for supplying electric current to said lamp socket and through the same to said light bulb to light the latter;

c) means for supporting said electric light, including a support member having at least one opening for the reception of said electric light bulb therethrough, a central portion and two wings flanking said central portion, said wings being connected to said central portion of said support member by respective vertically extending hinge regions as considered in an assembled condition of use of the decorative object for pivoting about said hinge regions at least as the decorative object is being assembled;

d) a translucent image-bearing member; and e) means for mounting said image-bearing member on said support member so as to be at least coextensive with a side of said support member for illumination by said light bulb when the latter is lit, said mounting means connecting said wings to said image-bearing member.

* * * * *